US007210968B1

(12) United States Patent
Gister et al.

(10) Patent No.: US 7,210,968 B1
(45) Date of Patent: May 1, 2007

(54) DUAL-LOCKING MECHANISM FOR LEAD AND HEADER ATTACHMENT IN PRE-MOLDED HEADERS

(75) Inventors: Mark Gister, Los Angeles, CA (US); Russell Klehn, Valencia, CA (US); Christopher Fleck, Canyon Country, CA (US)

(73) Assignee: Pacesetter, Inc., Sylmar, CA (US)

( * ) Notice: Subject to any disclaimer, the term of this patent is extended or adjusted under 35 U.S.C. 154(b) by 198 days.

(21) Appl. No.: 11/029,948

(22) Filed: Jan. 4, 2005

(51) Int. Cl.
*H01R 24/04* (2006.01)

(52) U.S. Cl. ..... 439/668; 439/909; 607/37

(58) Field of Classification Search ..... 439/668, 439/669, 909; 607/37
See application file for complete search history.

(56) References Cited

U.S. PATENT DOCUMENTS

| | | | | |
|---|---|---|---|---|
| 4,182,345 | A * | 1/1980 | Grose | 607/37 |
| 4,226,244 | A * | 10/1980 | Coury et al. | 607/37 |
| 4,934,366 | A | 6/1990 | Truex et al. | 128/419 P |
| 5,252,090 | A | 10/1993 | Giurtino et al. | 439/441 |
| 5,951,595 | A | 9/1999 | Moberg et al. | 607/37 |
| 2005/0065570 | A1 * | 3/2005 | Stein et al. | 607/37 |

FOREIGN PATENT DOCUMENTS

| | | | |
|---|---|---|---|
| EP | 0404877 | B1 | 3/1995 |
| EP | 0448651 | B1 | 7/1996 |
| GB | 2127629 | A * | 4/1984 |
| WO | WO 90/02581 | | 3/1990 |
| WO | WO 91/04069 | | 4/1991 |

* cited by examiner

*Primary Examiner*—Tho D. Ta

(57) ABSTRACT

A connector assembly for an implantable medical device including a casing includes a header having a receptacle with an electrical contact for engageably receiving an electrical terminal on a proximal end of a lead and a fastener assembly for simultaneously releasably clamping the lead to the header within the receptacle and firmly attaching the header to the casing. The header is mounted on the casing and has a distal notched region with an upper surface and a first channel in its upper surface aligned with, and being a partial extension of, the receptacle. The fastener assembly includes a lead-lock component engageably received within the notched region of the header and with a second channel therein which is aligned and juxtaposed with the first channel, the channels taken together being an extension of the receptacle. A fastener system firmly mounts the lead-lock component to the header at the notched region.

16 Claims, 7 Drawing Sheets

DUAL-LOCKING MECHANISM FOR LEAD AND HEADER ATTACHMENT IN PRE-MOLDED HEADERS

FIELD OF THE INVENTION

The present invention relates generally to electrical connector assemblies forming part of implantable medical devices (IMDs). Such connector assemblies have one or more electrical receptacles each adapted to receive an implantable lead and to connect the lead to electronic circuits within the IMD. More particularly, the invention relates to an electrical connector assembly which incorporates a fastener assembly for simultaneously releasably clamping a proximal end portion of the implantable lead within a receptacle of a header and firmly attaching the header to a casing of the implantable medical device.

BACKGROUND OF THE INVENTION

The present invention is applicable to a variety of IMDs utilizing pulse generators to stimulate selected body tissue. However, in this instance, the invention and its background will be described principally in the context of a specific example of such devices, namely, an implantable cardiac pacemaker and defibrillator unit having a connector assembly defining multiple lead-receiving receptacles. The appended claims are not intended to be limited, however, to any specific example or embodiment described herein.

Cardiac pacemakers, and other implantable stimulation devices such as cardioverters and defibrillators, are hermetically sealed within a housing or casing (sometimes also referred to as a "can") to isolate the electronic circuits contained within the device from the body environment. Such devices require that electrical signals be reliably passed between the hermetically sealed circuitry and external connectors without compromising the hermeticity of the device. Depending on the configuration of the implantable device there may be multiple electrical paths required between the device and its external connectors for delivering, for example, multi-chamber or multi-site stimulation and shock therapy, and for receiving sensed cardiac signals. These paths must be electrically and mechanically integrated with the device to provide a safe, long-term connector assembly that does not compromise the hermetic package.

Typically, a hermetic housing feedthrough electrically couples the electronic circuits contained within the device housing or casing to the connector assembly. The feedthrough extends through the wall of the hermetically sealed casing into the connector assembly so as to couple the electronic circuits within the casing to lead-receiving receptacles within the connector assembly. Each lead has one or more electrical terminals on a proximal end thereof, typically in the form of a pin terminal and one or more conductive ring terminals. Typically, the pin is electrically coupled to a distal tip electrode and is therefore sometimes called the "tip terminal." When the proximal end of the lead is inserted into the lead receptacle of a connector assembly, contacts within the receptacle come into contact with corresponding terminals on the lead so as to couple the lead to the electronic circuits within the implantable stimulation device via the feedthrough assembly. Needless to say, it is imperative that a completely dependable electrical connection be made and retained between the lead terminals and the corresponding connector assembly contacts. At the same time, the connector assembly must be capable of releasing the lead from the lead receptacle during explantation or other subsequent surgical procedure, and must also tightly seal against the entry of body fluids.

It is known in prior art connector assemblies to electrically and mechanically connect the proximal end of the lead within a receptacle of the connector assembly by means of a variety of expedients including captive fastening screw/collet arrangements and setscrews. In those prior art connector assemblies in which the lead is fixed within the lead receptacle using a setscrew, the setscrew is often threaded into an electrical connector block within the connector assembly. When the screw is advanced, it comes into contact with an associated terminal on the proximal end of the lead, mechanically and electrically coupling the lead and the connector assembly. However, the proximal end of a lead is sometimes damaged by an over-tightened setscrew and setscrews have a history of stripping out of the threaded connector block. To minimize or eliminate such problems, setscrews of a certain minimum physical size have been employed. The result is often a protrusion on the side of the connector assembly as the physical size of the pacemaker and its connector assembly is reduced.

A further problem of prior art setscrew type connector assemblies arises from the need to isolate the setscrew and the setscrew block from body fluids. One solution has been to use a silicone seal called a septum. The septum forms an insulation barrier between the setscrew and body fluids. However, the septum must permit a wrench to pass through it so that the screw can be tightened. Frequently, the septum is damaged by the wrench resulting in a loss of the insulation barrier.

One improvement is disclosed in U.S. Pat. No. 4,934,366 to Truex et al. which provides a feedthrough connector for a pacemaker, or other implantable medical device, that advantageously combines the connector function with the feedthrough function and eliminates the need for the cast epoxy connector previously used on prior art pacemakers. According to the Truex et al. patent, eliminating the external cast epoxy connector advantageously eliminates the need for septums, setscrews, and the feedthrough terminal and its associated platinum wires and connector blocks, as well as the whole time consuming casting process with its inherent propensity for cosmetic problems. In this patented instance, the feedthrough/connector includes a barrel assembly having an open end and a closed end. The open end of the assembly provides an opening into which the connecting end of a pacemaker lead, or other electrical lead, can be inserted. The barrel assembly includes metal (conductive) portions separated by ceramic (nonconductive) insulating portions. An overlap region of the conductive portions, separated by the nonconductive portion, advantageously provides structural strength as well as a capacitor structure which helps filter out unwanted electromagnetic interference (EMI) signals from passing through the connector. Spring contacts are mounted on the inside of the metal portions and are adapted to make electrical contact with the appropriate electrodes of the pacemaker or other electrical lead when the connecting end of the lead is inserted into the connector.

Another known improvement is disclosed in U.S. Pat. No. 5,252,090 to Giurtino et al. which discloses a connector assembly for an implantable stimulating device which employs a lead-locking spring clip to reliably provide a mechanical and electrical connection between the terminal pin of an electrode lead and the device, while reducing the user interaction required during implantation and disconnection. In this patented instance, no tools are required to establish the connection, nor is user action, other than inserting the lead into the connector, necessary to lock the lead into place. Disconnecting the lead requires only the application of a modest transverse compressing force to a release button on the connector assembly. In the event that a withdrawal force is applied to the lead without simultaneously applying the compressing force to the release button, the connector assembly increases its holding force on the electrode lead.

U.S. Pat. No. 5,951,595 to Moberg et al. discloses a connector assembly mounted on an implantable cardiac stimulation device having a side-actuated mechanism for fixing and tightly sealing electrical leads inserted into lead receptacles within an IMD connector assembly without the use of setscrews. In the Moberg et al. patent, fixing and sealing of the leads is accomplished by compressing resilient lead lock O-ring seals, disposed in annular recesses, with lip portions of a plunger drawn toward a molded support by the actuator mechanism.

It was in light of the foregoing that the present invention was conceived and has now been reduced to practice.

SUMMARY

An implantable medical device includes a casing and a header having a receptacle with an electrical contact for engageably receiving an electrical terminal on a proximal end of a lead and a fastener assembly for releasably clamping the lead to the header within the receptacle and firmly attaching the header to the casing.

In one embodiment, the header is mounted on the casing and has a distal notched region with an upper surface and a first channel in its upper surface aligned with, and being a partial extension of, the receptacle. The fastener assembly includes a lead-lock component engageably received within the notched region of the header and with a second channel therein which is aligned and juxtaposed with the first channel, the channels taken together being an extension of the receptacle. A fastener system firmly mounts the lead-lock component to the header at the notched region.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
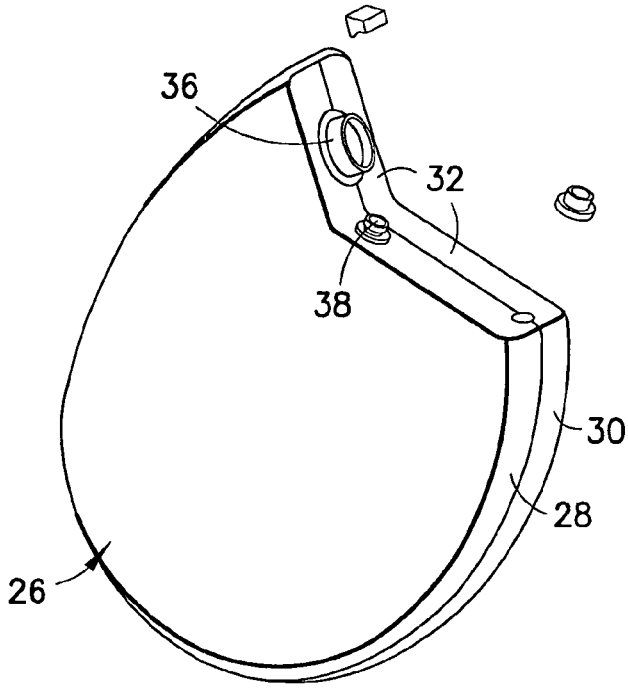
FIG. 1 is an exploded perspective view illustrating the casing of a pacemaker representing a typical pulse generator containing an hermetically sealed electronic package and being prepared to receive a connector assembly embodying the present invention.
Figure 2:
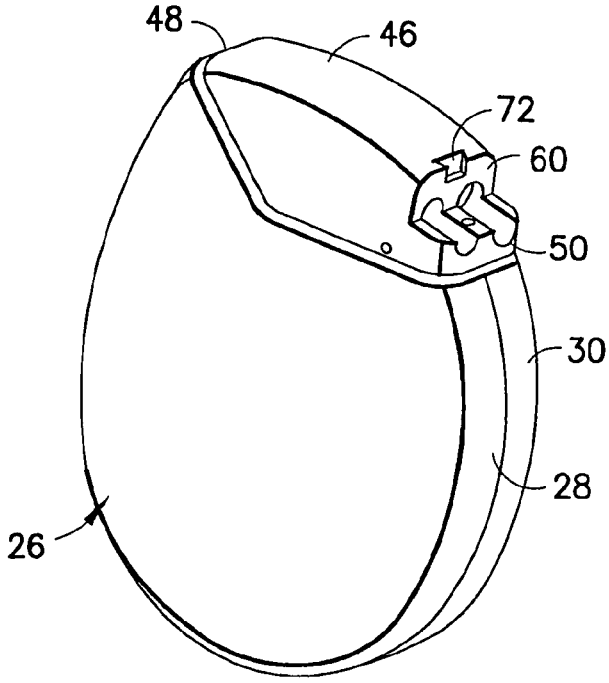
FIG. 2 is a perspective view of the pacemaker illustrated in FIG. 1 after a subsequent intermediate step has been performed toward attachment of a connector assembly embodying the present invention.
Figure 3:
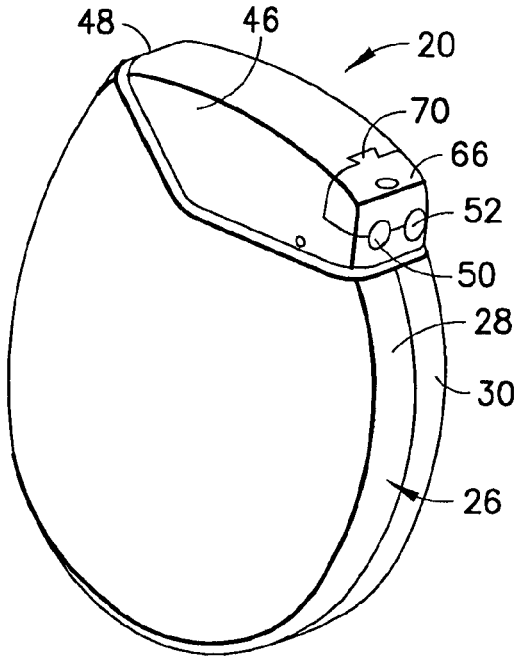
FIG. 3 is a perspective view of the pacemaker illustrated in FIGS. 1 and 2 after a all of the steps have been performed resulting in complete attachment of a connector assembly embodying the present invention.
Figure 4:
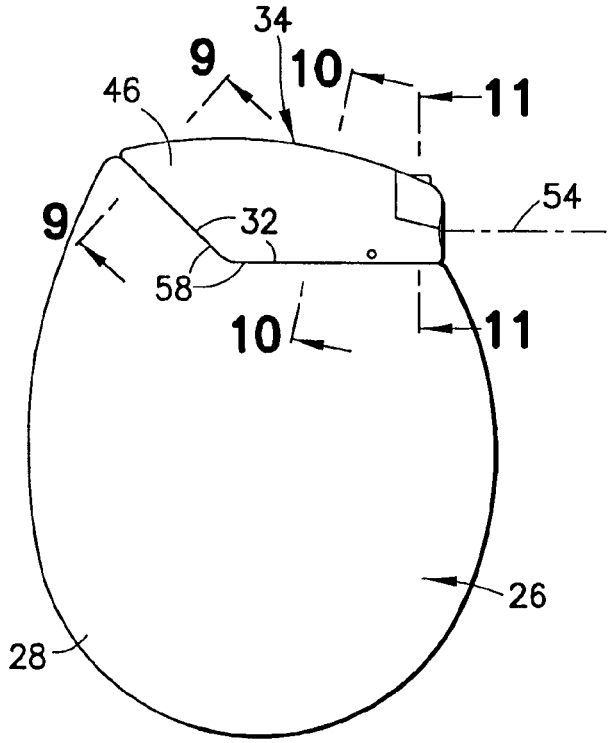
FIG. 4 is a side elevation view of the pacemaker illustrated in FIGS. 1, 2, and 3.

Refer now to the drawings and, initially, to FIGS. 1, 2, 3, and 4 which illustrate an implantable medical device (IMD) 20 in the form of a pulse generator such as a pacemaker or defibrillator intended to be introduced into an organ of a living body to provide stimulating pulses to selected body tissue, for example, into the heart. The device 20 represents an electronic package of a type to be hermetically sealed and enjoy the benefits of the present invention. Although the present invention will be described with reference to the embodiments shown in the drawings, it should be understood that the present invention can be embodied in many alternate forms or embodiments. Any suitable size, shape or type of elements or materials may be used to practice the invention.

Figure 5:
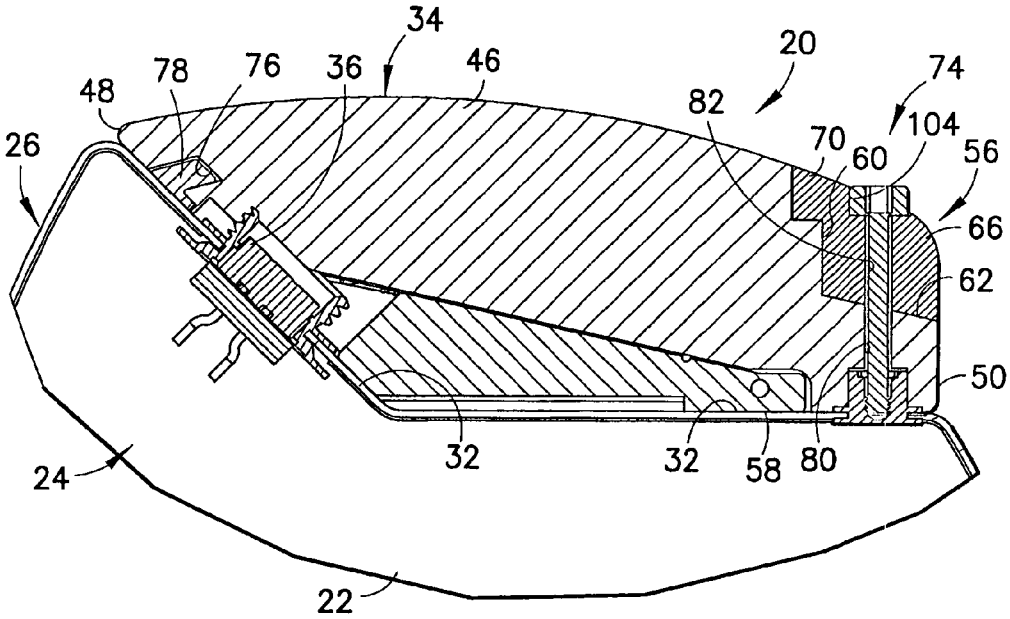
FIG. 5 is a detail cross section view, in elevation, illustrating the connector assembly of the invention.

In order to appreciate the advantages of the present invention, it will help first to have a basic understanding of the construction of a known IMD. As seen in FIG. 5, the IMD 20 chosen for descriptive purposes to be a pacemaker includes a battery 22 that powers electronic circuitry 24 mechanically housed and hermetically sealed in a suitable casing 26. Typically, this casing 26 is seen to include a first case half 28 and a second case half 30 which is matingly attachable to the first case half. When attached and properly sealed, the first and second case halves 28, 30 serve to encapsulate the electronic circuitry.

The casing 26 is shaped to include a primarily flat platform or mounting surface 32 to which a connector assembly 34 can be attached. At least one feedthrough terminal 36 (FIGS. 1 and 5), electrically isolated from the casing 26, is in electrical contact with the electronic circuitry 24, passes through the casing 26, and protrudes from the mounting surface 32. Another component of note, though not part of the invention, is the outwardly protruding backfill port 38 through which, in a known manner, after the case halves 28, 30 are joined and welded together, all gases are evacuated from the casing and nitrogen introduced.

The manner of attachment of the connector assembly 34 to the outside of said casing will be described below but the connector assembly serves to releasably affix one or more leads 40 (FIG. 13) having a proximal end portion 42 carrying at least one electrical terminal 44 for electrically coupling the feedthrough terminal 36 to the electronic circuitry 24 in a known manner. The receptacle may be variously configured, for example, to receive the proximal end portion of a pacing and/or sensing lead or of a cardioverting and/or defibrillating lead.

Figure 10:
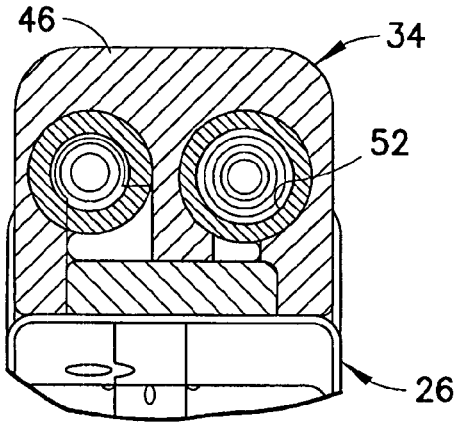
FIG. 10 is a cross section view taken generally along line 10—10 in FIG. 4.
Figure 11:
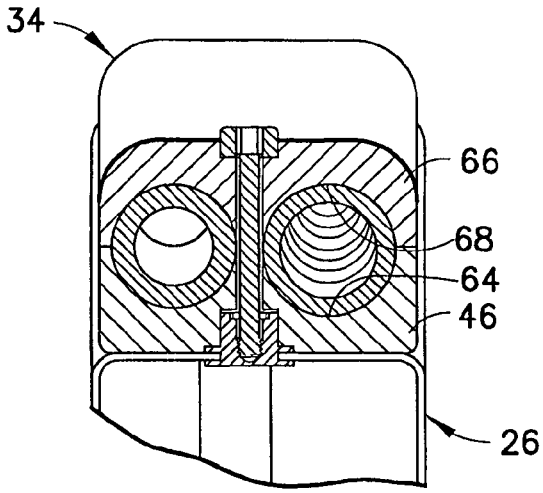
FIG. 11 is a cross section view taken generally along line 11—11 in FIG. 4.

The connector assembly 34 includes a header 46 extending between proximal and distal ends 48, 50, respectively, and has at least one elongated receptacle 52 (FIGS. 7 and 10), although two receptacles are actually illustrated and there may be more receptacles, generally of circular cross section, with a longitudinal axis 54 for receiving the proximal end portion 42 of the lead 40. In a known manner, the receptacle 52 carries an electrical contact positioned to engage the electrical terminal 44 and if there is more than one electrical terminal on the lead 40, there would be a similar number of spaced electrical contacts in the receptacle to make contact with the electrical terminals, eventually coupling with appropriate components of the electronic circuitry 24.

Figure 6:
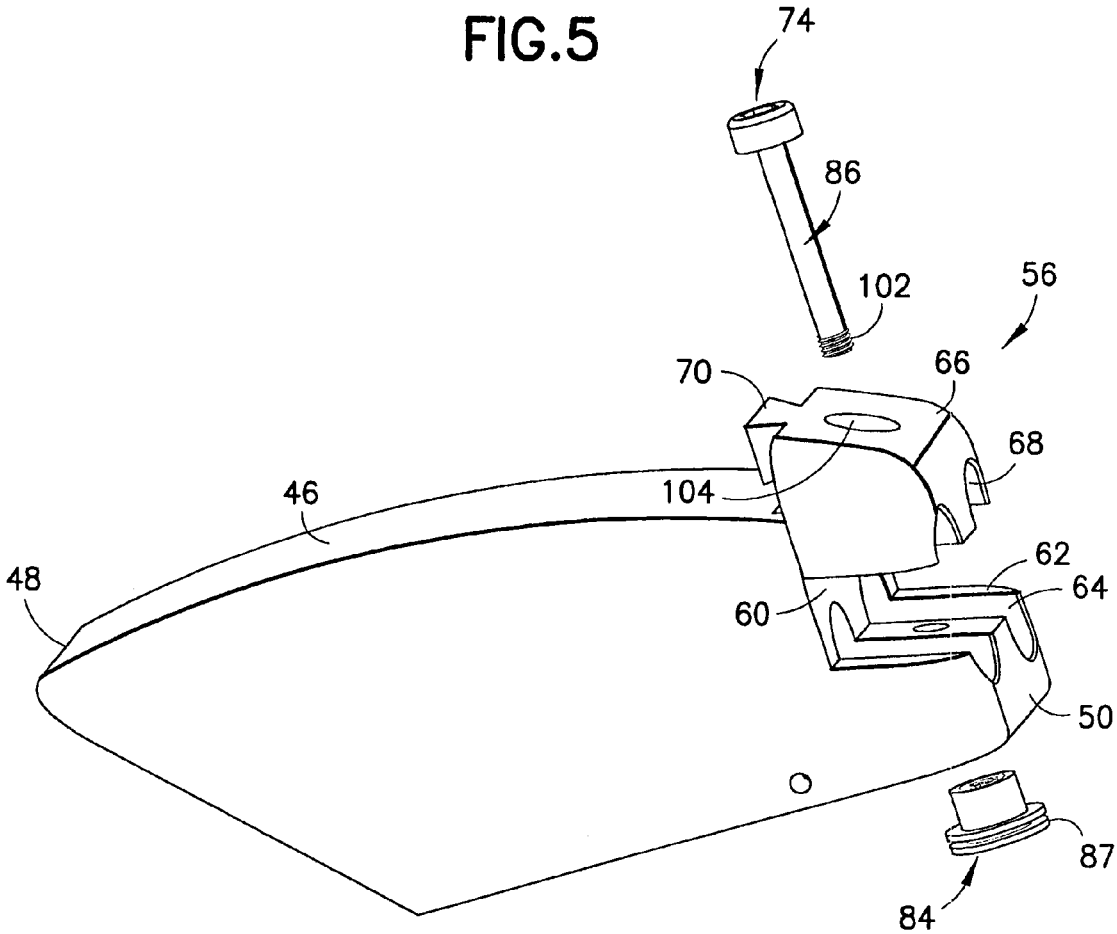
FIG. 6 is a detail exploded perspective view of the connector assembly of the invention.

The connector assembly 34 also includes a fastener assembly 56 (see especially FIGS. 5 and 6) for simultaneously releasably clamping the proximal end portion 42 of the lead 40 to the header 46 within the receptacle 52 and firmly attaching the header to the casing 26. The header 46 has an undersurface 58 for mounting engagement on the mounting surface 32 of the casing 26 and a notched region 60 (FIGS. 2, and 5–7) at its distal end 50 having an upper surface 62 spaced from the undersurface 58 of the header. The notched region 60 has a first channel 64 (actually a pair of channels is illustrated) formed in its upper surface 62 aligned with, and being a partial extension of, the receptacle 52.

The fastener assembly 56 includes a lead-lock component 66 for engageable reception with the notched region 60 of the header 46 and is formed with a second channel 68 (FIGS. 6 and 8) which, when engageably received in the notched region, is aligned and juxtaposed with the first channel 64 of the header 46, the first and second channels taken together being a full cylindrical extension of the receptacle 52 but having an inner diameter smaller than that of the receptacle when the connector assembly is firmly attached (as will be later explained) to the casing 26. Viewing especially FIGS. 2, 3, 5, and 6, the lead-lock component 66 includes a dovetail feature 70 at a location of engagement with the notched region 60 of the header 46. The header has a corresponding dovetail cutout 72 for slidable engageable reception of the dovetail feature 70 to assure axial and lateral alignment of the lead-lock component 66 relative to the header.

Figure 9:
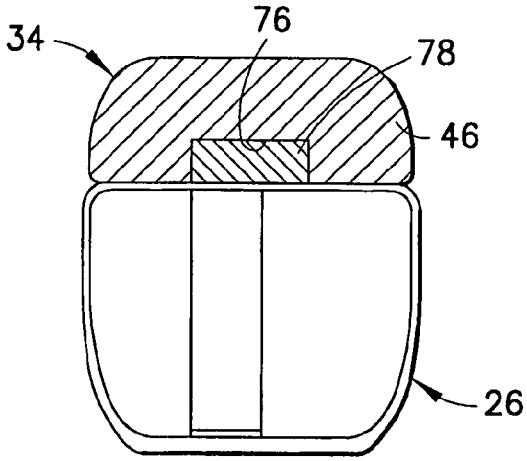
FIG. 9 is a cross section view taken generally along line 9—9 in FIG. 4.

The fastener assembly 56 also includes a fastener system 74 (FIGS. 5, 6, 11, 12A–12D) for firmly mounting the lead-lock component to the header 46 at the notched region 60. Assisting the fastener system 74, the header 46 has a mounting recess 76 (see FIGS. 5 and 9) at its proximal end 48 and an outwardly projecting brace 78 is fixed, as by welding, to the mounting surface 32 of the casing 26 for engageable reception in the mounting recess. A first through bore 80 is formed in the header 46 proximate its distal end 50 and extending transverse of the longitudinal axis 54 of the receptacle 52 from the upper surface 62 to the undersurface 58. The lead-lock component 66 has a second through bore 82 which is aligned with the first through bore 80 when the lead-lock component is firmly attached to the header 46 (FIG. 5).

Not only does the fastener system 74 include the outwardly projecting brace 78 fixed to the mounting surface 32 of the casing 26 for engageable reception in the mounting recess 76 of the header 46, but also an anchor 84 and a threaded fastener 86. The anchor 84 has a base mounting flange 87 for attachment as by welding to the mounting surface 32 of the casing 26. Also part of the anchor 84 is an upstanding mounting member 88 integral with the mounting flange 87 and containing an upwardly extending tapped bore 90 having first and second tapped regions 92, 94, respectively, spaced by a smooth bore region 96.

The threaded fastener 86 is received through the first and second through bores 80, 82, respectively, (FIG. 5) and is threadedly engaged with the anchor 84.

Figure 12A:
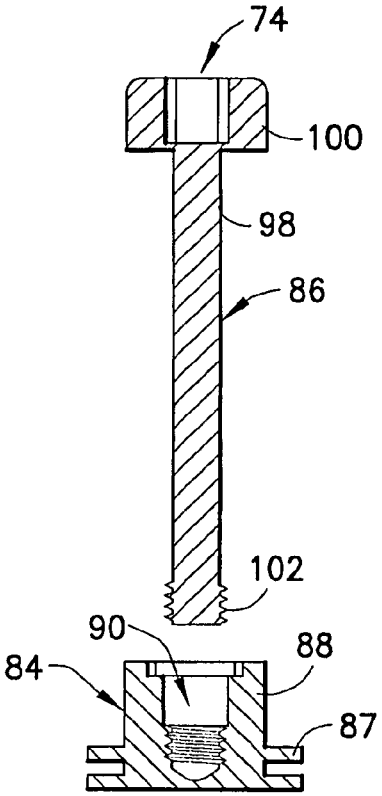
FIG. 12A is a detail cross section view illustrating in greater detail an initial position of components illustrated in FIG. 5.
Figure 12C:
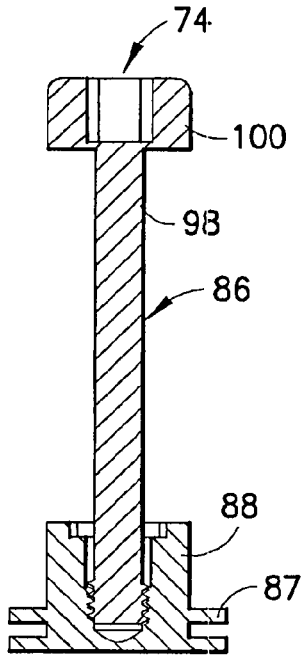
FIG. 12C is a detail cross section view illustrating in greater detail a final position of components illustrated in FIG. 5.
Figure 12B:
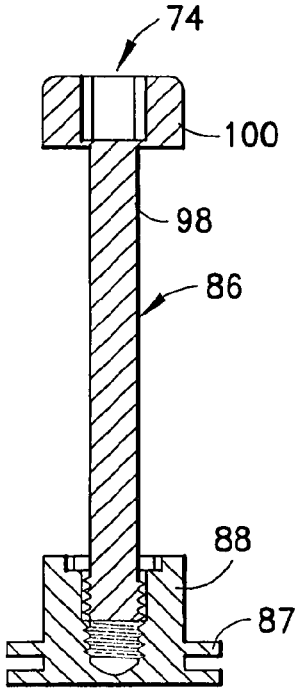
FIG. 12B is a detail cross section view illustrating in greater detail an intermediate position of components illustrated in FIG. 5.
Figure 12D:
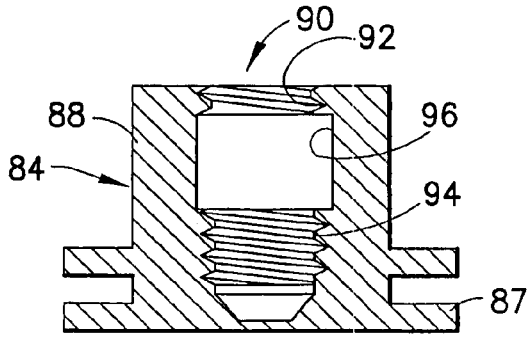
FIG. 12D is a detail cross section view illustrating in still greater detail one of the components illustrated in FIGS. 12A, 12B, and 12C.

Viewing FIGS. 12A, 12B, and 12C, the fastener 86 has a shank 98 and a head 100 and a threaded portion 102 of defined length adjacent its tip end. The lead-lock component 66 has a counter bore 104 (FIGS. 5 and 6) axially aligned with the first through bore 82 for reception of the head 100 of the fastener 86. The smooth bore region 96 (FIG. 12D) between the first and second tapped regions 92, 94 is longer than the defined length of the threaded portion 102 of the shank 98 of the fastener 86 such that as the fastener is tightened into engagement with the anchor, it is initially threaded through the first tapped region 92, then is advanced through the smooth bore region 96, then is threaded through the second tapped region 94 until the header 46 becomes firmly attached to the casing 26 and the lead-lock component 66 firmly clamps the proximal end portion 42 of the lead 40 to the header within the receptacle 52.

With this construction, then, it can be understood that an active mechanical lock is achieved by a three-component assembly including the lead-lock component 66, the anchor 84, and the fastener 86. The lead-lock component is molded of the same material as the pre-molded header, typically tecothane or other suitable biocompatible plastic material. The dovetail feature 70 fits into the corresponding dovetail cutout 72 in the header 46 to provide a tight axial and lateral alignment. The counter bored through bore 82 provides the opening for the fastener, aligning with the counter bored through hole 80 in the header 46 and the anchor 84. By tightening the fastener 86 with one or more of the leads 40 installed, the lead-lock component 66 clamps down on each of the leads, locking them in place and sealing the receptacles 52.

Also, as previously explained, the anchor 84 is designed so that the threaded portion 102 of the fastener 86 is captured within the anchor (see FIGS. 12A, 12B, 12C, and 12D). The fastener is initially threaded through the first tapped region 92 on the top of the tapped bore 90. Once through this tapped bore 90, the fastener can engage the main, or second, tapped region 94 of the anchor to secure the lead-lock component 66 and header 46. The fastener system 74 ensures that the fastener 86 cannot be easily disengaged from the anchor 84 using a torque wrench. An upward force on the fastener while turning it counterclockwise is needed to engage the first tapped region. Without this upward force, the fastener spins freely within the cavity of the smooth bore region 96. The downward pressure required by a torque wrench ensures that the attending physician will not be able to inadvertently disassemble the fastener assembly 56.

Also, as earlier noted, to fit the anchor design, the fastener has machined, protruding threads 102 with limited thread length to ensure it can spin freely in the anchor cavity of the smooth bore region 96.

To assemble the components, with particular attention to FIGS. 1, 2, 3, 7, and 8, the first step is the attachment of the anchor 84 and the brace 78 to the casing 26. The anchor 84 is preferably welded along with the feedthrough terminal 36 during the welding of the case halves 28, 30. Additional supports utilized to stabilize the header 46 on the casing 26 include the backfill port 38 and the feedthrough terminal 36 and additional bracing (not shown) may be welded above the feedthrough terminal after the case halves have been welded together.

Figure 7:
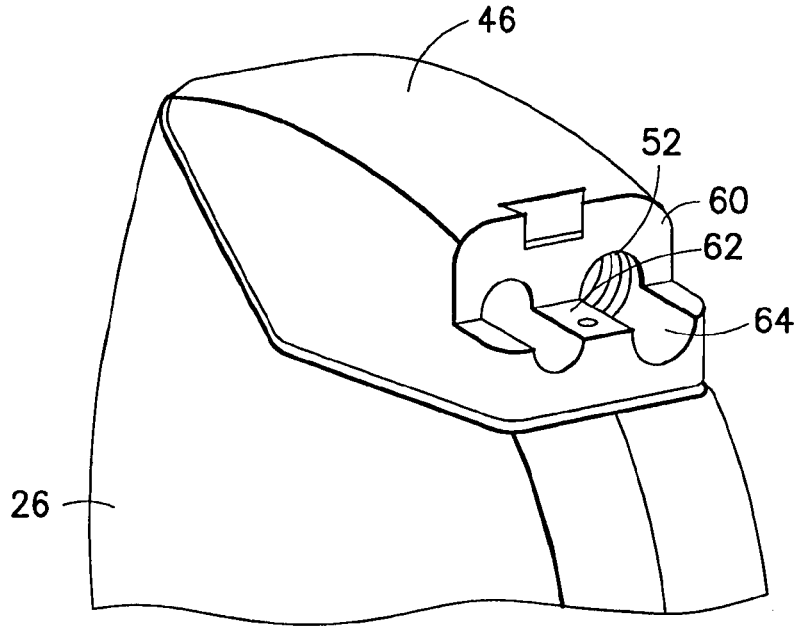
FIG. 7 is a detail perspective view illustrating in greater detail a portion of the pacemaker illustrated in FIG. 2.
Figure 8:
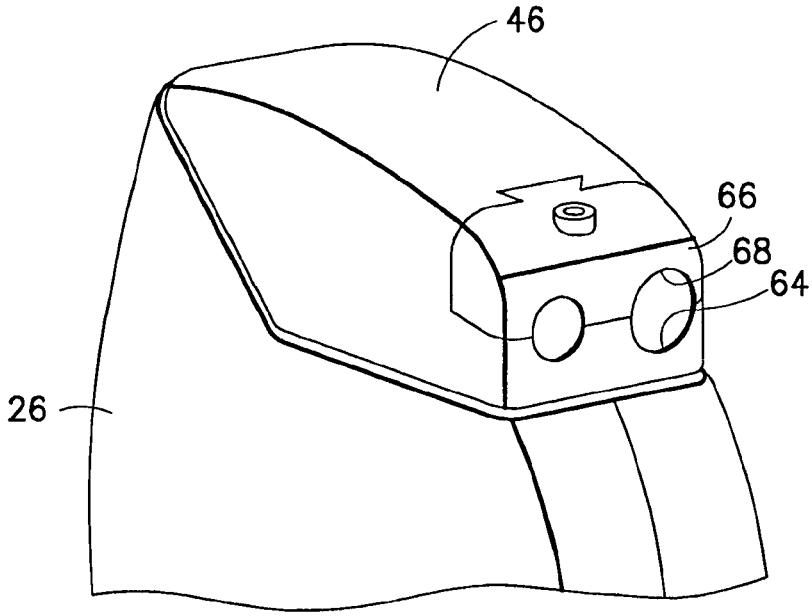
FIG. 8 is detail perspective view illustrating in greater detail a portion of the pacemaker illustrated in FIG. 3.

After the anchor 84 and brace 78 have been welded to the mounting surface 32 of the casing 26, the header is attached using the normal procedure: electrically connecting the header, followed by mechanically adhering the header using suitable medical adhesive (FIG. 7). The final assembly step is the attachment of the dovetailed lead-lock component 66 onto the header (FIG. 8). The dovetail feature 70 is slid into the corresponding dovetail cutout 72, and the fastener 86 is inserted and engaged into the anchor 84. The connector assembly is now completed, with the loosely tightened fastener adding header stability during shipping and initial period of the implantation procedure.

Figure 13:
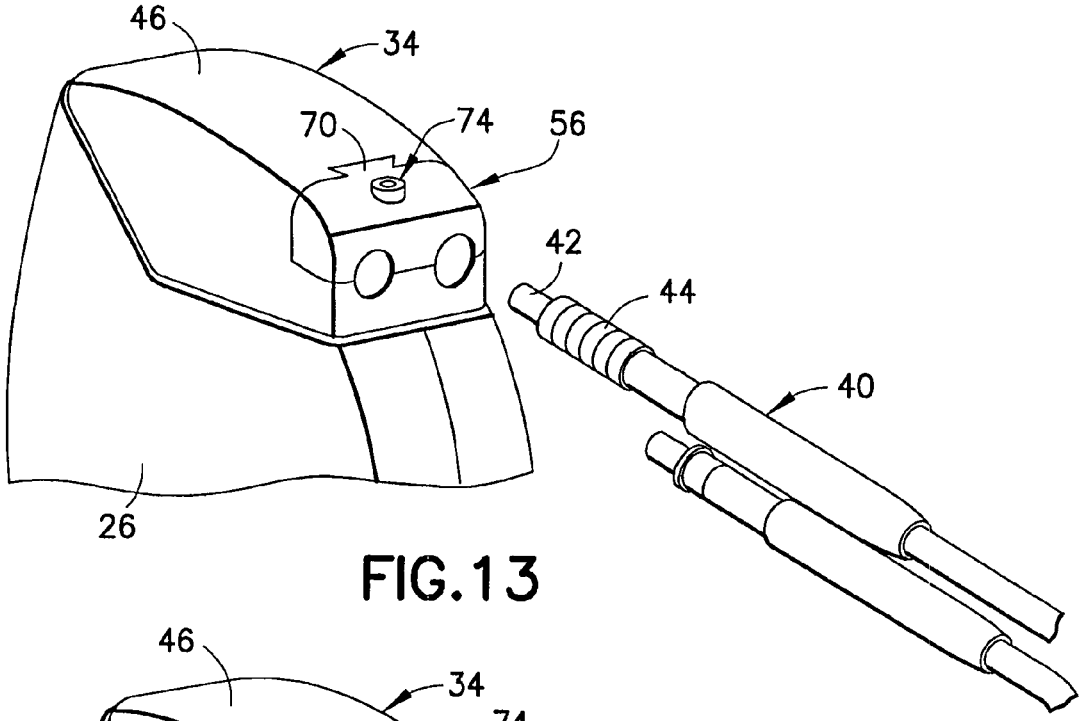
FIG. 13 is a detail perspective view illustrating in greater detail a portion of the pacemaker illustrated in FIG. 3, specifically, a casing and an associated header to which leads are being attached.
Figure 14:
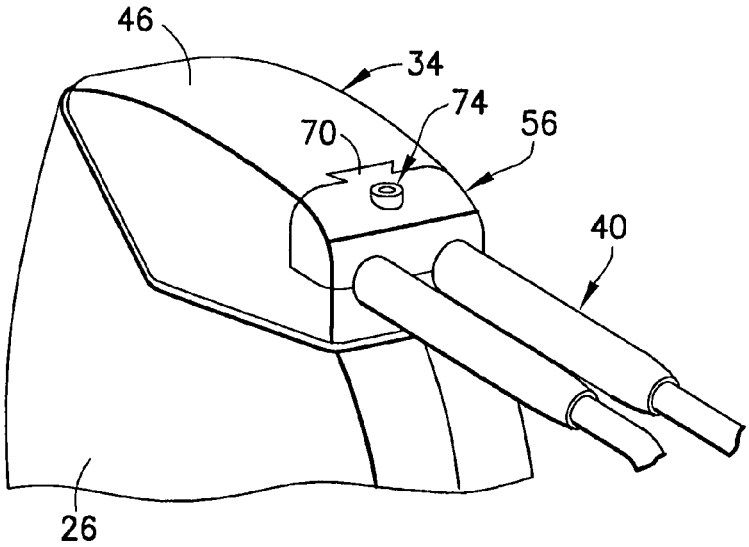
FIG. 14 is a detail perspective view similar to FIG. 14 illustrating the leads already attached to the header.
Figure 15:
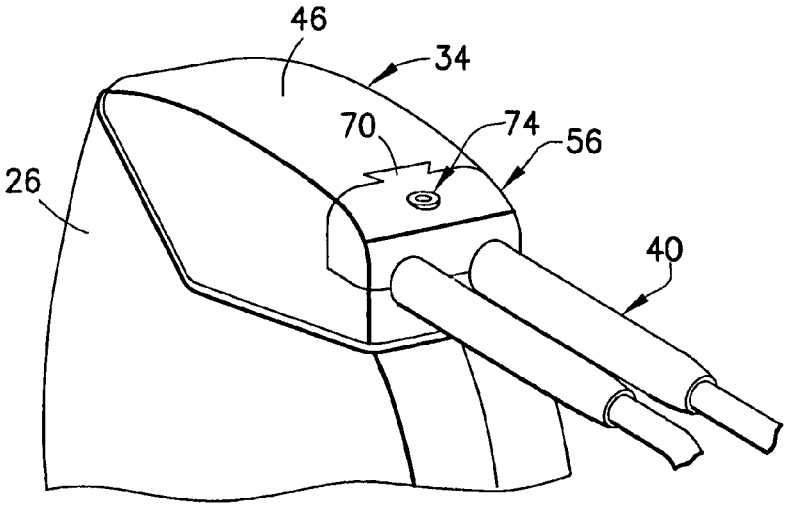
FIG. 15 is a detail perspective view similar to FIG. 14 but with the leads now sealingly attached to the header and the header firmly attached to the casing.

Finally, during implantation, the physician receives the medical device 20 with the fastener threads 102 captured in the anchor cavity of the smooth bore region 96 (FIG. 12B). The un-tightened fastener ensures that the physician can insert the leads without manipulation of the device. However, the encapsulation of the fastener within the anchor, along with the medical adhesive, will provide support for the header until it is fully secured. The physician inserts the leads 40, testing to ensure a proper connection (FIGS. 13, 14). The friction of the inserted leads within the receptacles 52 maintains the leads in the correct position. Then, the physician tightens the bolt using a torque wrench (FIG. 15). This action compresses the leads between the lead-lock component 66 and the header 46, resulting in a tight seal. This action also completes the mechanical attachment of the header to the casing, resulting in a solidly attached header.

This implantation procedure is preferred to the current method involving septums and the tightening of set-screws within the septum bores, for many reasons, including:

- ability to attach multiple leads using a single fastener;
- improved access to the fastener to help visual verification of full engagement of a torque wrench to eliminate stripping of the head of the fastener; and
- absence of septum use to reduce the possibility of damage to the medical device during implantation.

These improvements are achieved while retaining the familiar use of a torque wrench. The benefits will provide a quicker and more reliable implant procedure. An improved implant procedure means enhanced patient and physician satisfaction and fewer field returns. Combining these benefits with improved manufacturability results in a product with lower cost and higher sales potential.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A connector assembly for an implantable medical device including a casing having a mounting surface, the connector assembly comprising:

a header extending between proximal and distal ends having an elongated receptacle with a longitudinal axis for receiving a proximal end portion of a lead carrying at least one electrical terminal, the receptacle carrying an electrical contact positioned to engage the at least one electrical terminal; and a fastener assembly configured to releasably clamp the proximal end portion of the lead to the header within the receptacle and to attach the header to the casing, the fastener assembly comprising:

a lead-lock component to engage with the header; and a fastener with a threaded portion, the threaded portion engaging with a tapped portion of the casing to simultaneously firmly attach the header to the casing by mounting the lead-lock component to the header and to releasably clamp the proximal end portion of the lead to the header.

2. Connector assembly as set forth in claim 1 wherein the receptacle is configured to receive the proximal end portion of a pacing and/or sensing lead.

3. Connector assembly as set forth in claim 1 wherein the receptacle is configured to receive the proximal end portion of a cardioverting and/or defibrillating lead.

4. A connector assembly for an implantable medical device including a casing having a mounting surface, the connector assembly comprising:

a header extending between proximal and distal ends having an elongated receptacle with a longitudinal axis for receiving a proximal end portion of a lead carrying at least one electrical terminal, the receptacle carrying an electrical contact positioned to engage the at least one electrical terminal; and a fastener assembly configured to releasably clamp the proximal end portion of the lead to the header within the receptacle and to attach the header to the casing;

wherein the header has an undersurface for mounting engagement on the mounting surface of the casing and a notched region at its distal end having an upper surface spaced from the undersurface;

wherein the receptacle is cylindrical;

wherein the notched region has a first channel in its upper surface aligned with, and being a partial extension of, the receptacle; and wherein the fastener assembly includes:

a lead-lock component for engageable reception with the notched region of the header and having a second channel therein which, when engageably received in the notched region, is aligned and juxtaposed with the first channel of the header, the first and second channels taken together being a full cylindrical extension of the receptacle but having an inner diameter smaller than that of the receptacle when the connector assembly is firmly attached to the casing; and a fastener system for firmly mounting the lead-lock component to the header at the notched region.

5. Connector assembly as set forth in claim 4 wherein the lead-lock component includes a dovetail feature at a location of engagement with the notched region of the header; and wherein the header has a corresponding dovetail cutout for slidable engageable reception of the dovetail feature to assure axial and lateral alignment of the lead-lock component relative to the header.

6. Connector assembly as set forth in claim 4 wherein the header has a mounting recess at its proximal end and a first through bore proximate the distal end thereof and extending transverse of the longitudinal axis of the receptacle from the upper surface to the undersurface;

wherein the lead-lock component has a second through bore aligned with the first through bore when the lead-lock component is firmly attached to the header; and wherein the fastener system includes:

an outwardly projecting brace fixed to the mounting surface of the casing for engageable reception in the mounting recess of the header;

an anchor having an upwardly extending tapped bore fixed to the mounting surface of the casing distant from the brace;

a threaded fastener received through the first and second through bores and threadedly engaged with the anchor;

whereby, as the fastener is tightened into engagement with the anchor, the header becomes firmly attached to the casing and the lead-lock component firmly clamps the proximal end portion of the lead to the header within the receptacle.

7. Connector assembly as set forth in claim 6 wherein the fastener has a shank and a head; and wherein the lead-lock component has a counter bore axially aligned with the first through bore for reception of the head of the fastener.

8. Connector assembly as set forth in claim 6 wherein the fastener includes:

a head;

an integral shank extending from the head to a tip end; and a threaded portion of defined length adjacent the tip end; and wherein the anchor includes:

a base mounting flange for attachment to the mounting surface of the casing;

an upstanding mounting member integral with the flange and containing the upwardly extending tapped bore;

the tapped bore having first and second tapped regions spaced by a smooth bore region which is longer than the defined length of the threaded portion of the shank of the fastener;

whereby, as the fastener is tightened into engagement with the anchor, it is initially threaded through the first tapped region, then is advanced through the smooth bore region, then is threaded through the second tapped region until the header becomes firmly attached to the casing and the lead-lock component firmly clamps the proximal end portion of the lead to the header within the receptacle.

9. An implantable medical device comprising:

a sealed casing having a mounting surface;

electronic circuitry enclosed within said casing; and a connector assembly attached to the outside of said casing for releasably affixing a lead having a proximal end portion carrying at least one electrical terminal and for electrically coupling the at least one electrical terminal to the electronic circuitry, the connector assembly comprising:

a header extending between proximal and distal ends having an elongated receptacle with a longitudinal axis for receiving a proximal end portion of a lead carrying at least one electrical terminal, the receptacle carrying an electrical contact positioned to engage the at least one electrical terminal; and a fastener assembly simultaneously operative to releasably clamp the proximal end portion of the lead to the header within the receptacle and firmly attach the header to the casing, the fastener assembly comprising:

a lead-lock component to engage with the header; and a fastener with a threaded portion, the threaded portion engaging with a tapped portion of the casing to simultaneously firmly attach the header to the casing by mounting the lead-lock component to the header and to releasably clamp the proximal end portion of the lead to the header.

10. An implantable medical device as set forth in claim 9 wherein the receptacle is configured to receive the proximal end portion of a pacing and/or sensing lead.

11. An implantable medical device as set forth in claim 9 wherein the receptacle is configured to receive the proximal end portion of a cardioverting and/or defibrillating lead.

12. An implantable medical device comprising:

a sealed casing having a mounting surface;

electronic circuitry enclosed within said casing; and a connector assembly attached to the outside of said casing for releasably affixing a lead having a proximal end portion carrying at least one electrical terminal and for electrically coupling the at least one electrical terminal to the electronic circuitry, the connector assembly comprising:

a header extending between proximal and distal ends having an elongated receptacle with a longitudinal axis for receiving a proximal end portion of a lead carrying at least one electrical terminal, the receptacle carrying an electrical contact positioned to engage the at least one electrical terminal; and a fastener assembly operative to releasably clamp the proximal end portion of the lead to the header within the receptacle and firmly attach the header to the casing;

wherein the header has an undersurface for mounting engagement on the mounting surface of the casing and a notched region at its distal end having an upper surface spaced from the undersurface;

wherein the receptacle is cylindrical;

wherein the notched region has a first channel in its upper surface aligned with, and being a partial extension of, the receptacle; and wherein the fastener assembly includes:

a lead-lock component for engageable reception with the notched region of the header and having a second channel therein which, when engageably received in the notched region, is aligned and juxtaposed with the first channel of the header, the first and second channels taken together being a full cylindrical extension of the receptacle but having an inner diameter smaller than that of the receptacle when the connector assembly is firmly attached to the casing; and a fastener system for firmly mounting the lead-lock component to the header at the notched region.

13. An implantable medical device as set forth in claim 12 wherein the lead-lock component includes a dovetail feature at a location of engagement with the notched region of the header; and wherein the header has a corresponding dovetail cutout for slidable engageable reception of the dovetail feature to assure axial and lateral alignment of the lead-lock component relative to the header.

14. An implantable medical device as set forth in claim 12 wherein the header has a mounting recess at its proximal end and a first through bore proximate the distal end thereof and extending transverse of the longitudinal axis of the receptacle from the upper surface to the undersurface;

wherein the lead-lock component has a second through bore aligned with the first through bore when the lead-lock component is firmly attached to the header; and wherein the fastener system includes:

an outwardly projecting brace fixed to the mounting surface of the casing for engageable reception in the mounting recess of the header;

an anchor having an upwardly extending tapped bore fixed to the mounting surface of the casing distant from the brace;

a threaded fastener received through the first and second through bores and threadedly engaged with the anchor;

whereby, as the fastener is tightened into engagement with the anchor, the header becomes firmly attached to the casing and the lead-lock component firmly clamps the proximal end portion of the lead to the header within the receptacle.

15. An implantable medical device as set forth in claim 14 wherein the fastener has a shank and a head; and wherein the lead-lock component has a counter bore axially aligned with the first through bore for reception of the head of the fastener.

16. An implantable medical device as set forth in claim 14 wherein the fastener includes:

a head;

an integral shank extending from the head to a tip end; and a threaded portion of defined length adjacent the tip end; and wherein the anchor includes:

a base mounting flange for attachment to the mounting surface of the casing;

an upstanding mounting member integral with the flange and containing the upwardly extending tapped bore;

the tapped bore having first and second tapped regions spaced by a smooth bore region which is longer than the defined length of the threaded portion of the shank of the fastener;

whereby, as the fastener is tightened into engagement with the anchor, it is initially threaded through the first tapped region, then is advanced through the smooth bore region, then is threaded through the second tapped region until the header becomes firmly attached to the casing and the lead-lock component firmly clamps the proximal end portion of the lead to the header within the receptacle.

* * * * *